United States Patent [19]

Klein et al.

[11] 4,247,471

[45] Jan. 27, 1981

[54] PROCESS FOR THE PRODUCTION OF A PLURALITY OF EDIBLE FRACTIONS FROM NATURAL FATTY SUBSTANCES, AND THE FRACTIONS PRODUCED IN THIS WAY

[75] Inventors: Jean M. Klein, Couderoue-Branche; Albert Lacome, Dunkerque, both of France

[73] Assignee: Lesieur-Cotelle & Associes S.A., Hauts de Sene, France

[21] Appl. No.: 43,936

[22] Filed: May 31, 1979

[30] Foreign Application Priority Data

May 31, 1978 [FR] France ..... 78 16181

[51] Int. Cl.[3] ..... C11C 3/02

[52] U.S. Cl. ..... 260/410.7; 426/607

[58] Field of Search ..... 260/410.7; 426/607

[56] References Cited

U.S. PATENT DOCUMENTS

| | | | |
|---|---|---|---|
| 2,442,535 | 6/1948 | Eckey | 260/410.7 |
| 2,442,539 | 6/1948 | Eckey | 260/410.7 |
| 2,875,066 | 2/1959 | Holman et al. | 260/410.7 |
| 3,686,240 | 8/1972 | Kawada et al. | 426/607 |
| 4,004,041 | 1/1977 | Koslowsky | 260/410.7 |
| 4,055,679 | 10/1977 | Kattenberg et al. | 426/607 |

OTHER PUBLICATIONS

Bahin (Oleagineux, 29th yr., No. 7, 7/1974, pp. 375–378).

*Primary Examiner*—John F. Niebling

*Attorney, Agent, or Firm*—Seidel, Gonda, Goldhammer & Panitch

[57] ABSTRACT

Four edible fractions with specific properties are produced from natural fatty substances by fractionating the substance to be treated by means of solvents, under given conditions in respect of fatty material:solvent proportions and temperature, then interesterifying an intermediate fluid fraction which is produced by fractionation, which is then fractionated, like, optionally, the solid fractions produced.

The four fractions respectively contain unsaturated triglycerides, symmetrical oleodipalmitin, mixed triglycerides and saturated triglycerides.

20 Claims, 2 Drawing Figures

Figure 1A:
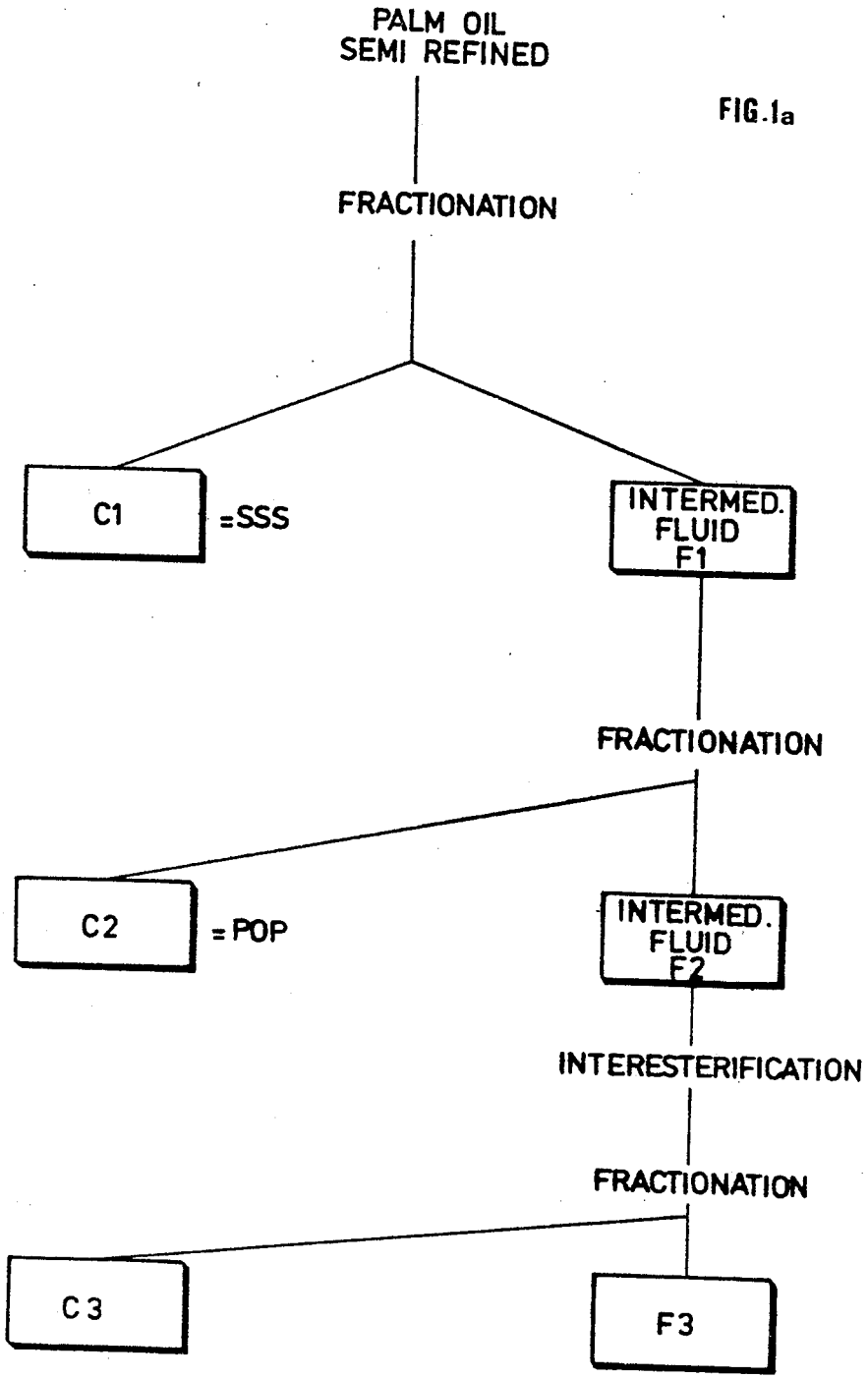

PALM OIL
SEMI REFINED

FRACTIONATION
C1
=SSS
INTERMED.
FLUID
F1
FRACTIONATION
C2
=POP
INTERMED.
FLUID
F2
INTERESTERIFICATION
FRACTIONATION
C3
F3

PROCESS FOR THE PRODUCTION OF A PLURALITY OF EDIBLE FRACTIONS FROM NATURAL FATTY SUBSTANCES, AND THE FRACTIONS PRODUCED IN THIS WAY

The present invention relates to a process for the production of a plurality of edible fractions from natural fatty substances such as oils or fats and more particularly from palm oil; it also concerns the edible fractions which are produced by this process.

It is known that natural fatty substances are generally complex mixtures of triglycerides, the composition of which includes saturated fatty acids (solid) and unsaturated fatty acids (fluids) with different chain lengths. The composition in respect of fatty acids, and the distribution thereof within the triglyceride molecules, are particular to each type of oil and determine the melting point thereof. However, in the case of mixtures which form natural fats, insolubility phenomena arise.

As regards the composition of the palm oil which is at the present time on the market, a certain equilibrium can be noted between the total content of saturated and unsaturated fatty acids, with one or other of such acids predominating, depending on the country of origin and the variety. However, the distribution of the fatty acids in the molecule makes it difficult to provide for clear separation into two fractions; the amounts of tri-unsaturated triglycerides (with 3 unsaturated fatty acids) and trisaturated triglycerides (with 3 saturated fatty acids) are low whereas, for the present-day varieties, the disaturated-monounsaturated and monosaturated-diunsaturated substances are to be found in almost equal amounts, that is to say, about 45%, which can develop in the future with new varieties of palm-trees, for example the Guineansis-Melanococca hybrid. Now, in order to produce an oil which is comparable to the commercially available vegetable oils, it is necessary to separate from the palm oil, the most highly unsaturated triglycerides (with two double bonds or more), primarily corresponding to triglycerides having two or three unsaturated fatty acids in the molecule.

In view of the increasing attractiveness of palm oil in the world markets, many efforts have been made for perfecting processes for separating palm oil and other fatty materials having close physical properties and close chemical composition, into solid fractions with a high melting point and with a high proportion of saturated fatty acids, and fluid fractions with a low melting point and with a high proportion of unsaturated fatty acids.

It has been found that the processes for fractionating the natural fatty material used do not make it possible to obtain fractions in which the separation between the saturated fatty acids in the solid fractions and the unsaturated fatty acids in the fluid fractions is perfectly satisfactory; indeed, the chemical structure of the fatty substance, palm oil in the present case, is a factor which limits the respective degrees of separation, so that, irrespective of the fractionating processes used, a part of the unsaturated fatty acids remains in the solid fraction.

From this, the inference has been drawn that satisfactory separation can be obtained only by attacking the chemical structure of the triglyceride molecule of palm oil, in order to displace the unsaturated fatty acids which are in the triglycerides comprising two saturated acids and an unsaturated acid, towards a tri-unsaturated formation or at least a monosaturated-diunsaturated formation.

It is in this way that the applicants have come to perfect processes which combine fractionation with interesterification.

The processes known in the prior art generally aim to produce a preponderant fraction which has given characteristics; depending on whether such processes seek essentially to produce a fluid fraction or a solid fraction, the fractionating and interesterification temperatures used in such processes are more or less high; thus, processes are known for example, which aim to produce a solid fraction of mixed triglycerides by cooling the oil to be treated at a temperature of from 4° to 5° C. for 1 to 5 days, followed by interesterification at the same temperature, for a period of the order of 3 to 5 days followed by fractional crystallisation from a suitable solvent at a temperature of 20° to 21° C. (U.S. Pat. No. 2,442,535). Likewise, a solid fraction containing fine crystals of saturated triglycerides (SSS) can be produced by simultaneous crystallisation and interesterification at temperatures which progressively rise from 21° to 38° C. (U.S. Pat. No. 2,875,066).

Other known processes are essentially concerned with the production of a fluid fraction, this being the case in particular with regard to U.S. Pat. No. 2,442,539 wherein interesterification is effected at a temperature of the order of 49° C. and is followed by fractionation at 18° C., in a solvent which is present in a proportion of 4/1 with respect to the treated oil, and includes stages for recycling of the solid fraction produced from the fractionating operation, at the same time as the fluid fraction. This is also the case with the process described in the publication Babin (Oleagineux, 29th year, No. 7, July 1974, pages 375–378) which provides for fractionation by centrifuging in the presence of a surface-active agent in order to produce a solid fraction and a fluid fraction which is subjected to interesterification at 33° to 36° C., in which the order of said two stages in the process can be reversed in order to improve the proportion and the quality of the fluid fraction obtained. A process seeking to produce a fluid fraction has also been proposed, in which transesterification of palm oil with a fatty acid ester of a $C_1$ to $C_3$ alkanol is effected (French Pat. No. 75 35 734). The prior art does not show that a single process can make it possible to produce a fluid fraction with an iodine number of higher than 80 and two or more solid fractions that can all be utilised in the foodstuffs industry.

The present invention provides a process for the treatment of natural fatty substances and in particular fatty substances having a saturated:unsaturated ratio ranging from 0.3:1 to 1.2:1, the typical example of which is palm oil, for the production of at least two edible fractions, comprising stages for fractionation of the fat to be treated by means of suitable fat-fractionating solvents, the weights of which are from 0.5 to 7 times the weight of the fat, at temperatures of from +35° C. to −20° C., in order to produce one or two solid fractions and an intermediate fluid fraction, and a stage for interesterification of the intermediate fluid fraction, which is carried out in the presence of a suitable interesterification catalyst at a temperature of from 20° to 80° C., the main treatment stages being associated with a stage of complementary fractionation of the intermediate interesterified fluid fraction, and optionally being associated with complementary stages for fractionation of the solid fraction or fractions, in which the said complementary fractionating stages use a suitable fat-fractionating solvent in order to produce four fractions that have properties of edible fats, namely: a fluid fraction with an iodine number of higher than 80, which essentially contains unsaturated triglycerides and has a tri-unsaturated triglycerides content exceeding 20% and the properties of edible oils such as peanut oil and olive oil; a solid fraction having an iodine number of from 31 to 43, which essentially comprises 2-oleo-1,3-dipalmitin and can be used as a substitute base for cocoa-butter; a solid fraction with an iodine number of from 33 to 43, which contains mixed triglycerides and can be used in different sectors of the foodstuffs industry and in particular in the production of margarine; and a solid fraction with an iodine number of lower than 20, which essentially contains saturated triglycerides and can preferably be utilised in lipochemical uses or in different sectors of the foodstuffs industry.

Preferably a first fractionating stage is carried out at a temperature of from 0° to +35° C. to produce a solid fraction that essentially comprises saturated triglycerides having an iodine number of lower than 20, and a solid intermediate fraction that is subjected to a fresh fractionating treatment at a temperature of from +15° to −20° C. in from 2 to 7 times its weight of fractionating solvent to produce a solid fraction essentially comprising 2-oleo-1,3-dipalmitin and an intermediate fluid fraction, which is subjected to interesterification in the presence of a suitable catalyst at a temperature of about 80° C., for a period of 30 to 60 minutes, followed by a fresh fractionating step in a fractionating solvent, preferably trichlorotrifluoroethane or hexane present in an amount up to 7 times the weight of the interesterified fluid fraction to be treated, at a temperature of up to −20° C., to produce a solid fraction that essentially comprises mixed triglycerides having an iodine number of from 33 to 43, and a fluid fraction that essentially comprises unsaturated triglycerides having an iodine number of higher than 80, which has a content of tri-unsaturated triglycerides exceeding 20% and the properties of edible oils such as peanut oil and olive oil.

Advantageously the first fractionation stage is carried out at a temperature of from +20° C. to −20° C., depending on whether the weight of fractionating solvent is one or seven times the weight of the material to be treated, to produce (a) a solid fraction, which is subjected to a fresh fractionating step in a solvent medium, thereby making it possible to recover a first solid fraction essentially comprising saturated triglycerides with an iodine number of less than 20, and a second solid fraction which essentially comprises 2-oleo-1,3-dipalmitin; and (b) an intermediate fluid fraction, which is interesterified at a temperature of about 80° C. in the presence of a suitable interesterification catalyst, then fractionated in a fractionating solvent, preferably trichlorotrifluoroethane or hexane, which is present in a weight of up to 7 times the weight of the interesterified fluid fraction to be treated, at a temperature of up to 20° C., to produce a solid fraction that essentially comprises mixed triglycerides with an iodine number of from 33 to 43, and a fluid fraction which essentially comprises unsaturated triglycerides with a tri-unsaturated triglyceride content in excess of 20%, an iodine number of higher than 20, and the properties of edible oils such as peanut oil and olive oil.

The process in accordance with the invention for the production of four edible fractions of given characteristics from natural fatty materials having a saturated:unsaturated ratio of from 0.3:1 to 1.2:1 makes it possible to attain particularly attractive yields in respect to the four fractions, since the yield in respect of the fluid fraction comparable to peanut or olive oil is higher, for present-day varieties, than 30%, and can even attain 50%, while the yield in respect of the solid fraction, which can be used as a substitute base for cocoa-butter is at least 30% and may even reach 45%, the yield in respect of the solid fraction essentially comprising mixed triglycerides is 10 to 30%, and the yield in respect of the solid fraction essentially comprising saturated triglycerides is generally from 5 to 15%. Such yields permit of maximum utilisation of the fatty material.

The fractionating solvent used can advantageously be trichlorotrifluoroethane, hexane, isopropanol or acetone, the different fractionating stages of the process being by using one or more of the above-indicated fractionating solvents.

Advantageously the fractionating operations are carried out by using amounts of solvent which represent from 0.5 to 7 times the weight of the fatty material or the treated fraction, the fractionating temperature being from +35° C. to −20° C., depending on (a) the proportion of solvent relative to the fatty material or to the treated fraction used for the fractionating operation, and (b) the type of solvent used.

Advantageously the interesterification is a free interesterification operation carried out in an oil phase at a temperature of from 60° to 80° C. in the presence of a suitable interesterification catalyst, preferably an alkali metal alcoholate, for a period of from 30 to 60 minutes.

Advantageously the interesterification step is a directed interesterification operation carried out in the oil phase, at a temperature of from 20° to 40° C. in the presence of a suitable interesterification catalyst, preferably an alkali metal alcoholate, for a period of from 1 to 6 hours and preferably from 1 to 3 hours.

In accordance with another feature of the invention, the interesterification step may be a directed interesterification operation carried out in the solvent phase at a temperature of 20° to 40° C. in the presence of a suitable interesterification catalyst, preferably an alkali metal alcoholate, for a period of from 1 to 6 hours and preferably from 1 to 3 hours, the solvent being present in a proportion of from 0.05 to 0.4 parts by weight with respect to the fatty material to be treated.

The amount of catalyst is preferably 0.2 to 0.4% by weight of the weight of the fraction subjected to interesterification, while the catalyst used may be for example sodium methylate.

The interesterification reaction is stopped at the desired moment by destruction of the catalyst in known manner, e.g. by introducing about 3% of water of 1% of acetic acid, based on the weight of the interesterified fraction.

Performing the process according to the present invention can provide particularly substantial advantages in the treatment of palm oil, since the process of the invention permits of optimum utilisation of the oil. Palm oil is extracted from the fruit of the oil palm tree which is found in tropical countries (tropical Africa, Sumatra, Malaysia and tropical Amercia). It is distinguished by its relatively high content of palmitic acid which, as is known, is a $C_{16}$ saturated fatty acid (about 42% with the present-day varieties) and its relatively low content of oleic acid, which is a $C_{18}$ unsaturated fatty acid (about 38% with the present-day varieties) while peanut oil and olive oil respectively contain about 10% and about 15% of palmitic acid and about 55% and about 65% of oleic acid. The relatively high proportion of palmitic acid is the cause of the poor resistance to cold of palm oil and the fact that it is not possible for palm oil to be used, as it is, as a salad-dressing oil, in the temperate or cold climates of Europe, North America or Japan.

Besides the advantages attained by optimum utilisation of palm oil, in accordance with the invention, another attraction of the process according to the present invention as that it concentrates and increases the proportion of natural tocopherols (vitamin E) in the fluid fraction, these being substances which are highly attractive by virtue of their anti-oxygen and biological properties. This is illustrated in Table I below:

TABLE I

| | Basic palm oil | Solid $C_1$ (SSS) | Solid $C_2$ (POP) | Solid $C_3$ (SSI) | Fluid oil desired |
|---|---|---|---|---|---|
| Content of tocopherols in mg/100g of oil | (X) 58 | 15 | 12 | 10 | 95 |

(X) the proportions of tocopherols are determined by oxido-reduction and then colorimetry, using conventional methods, and expressed in respect of equivalent of α-tocopherol.

The figures set out in the table above, concern fatty substances at the same stage of refining (oil coming into deodorisation).

Concentration in the fluid oil of the tocopherols which are present in palm oil provides the following advantages:

(a) Preservation of the taste properties: it is desirable for the most highly unsaturated oil fraction to be enriched with natural anti-oxygens as it is the most sensitive to oxidation.

From this point of view, the process makes it possible to produce a fluid oil which is suitably protected by its natural anti-oxygens and which does not require any addition of synthetic anti-oxygens such as for example BHA and BHT, the use of which in the foodstuffs industry is at the present time under critical review.

The solid fractions, which are less oxidisable, contain sufficient quantities of tocopherols, for this type of product.

(b) Vitamin E/polyunsaturated fatty acids equilibrium: recent works (cf. The Role of fats in human nutrition—edited by A. J. VERGROESEN, ch. 9: 'Linoleic acid intake and vitamin E requirement' by F. C. JAGER, pages 381–425—Academic Press ed. 1975), have shown the importance of tocopherols in the ingestion of polyunsaturated fatty acids and more particularly linoleic acid.

From this point of view, palm oil appears to have a very good vitamin E/polyunsaturated fatty acids equlibrium (see the Figure on page 425 of the above-quoted work). The process according to the present invention provides the advantage of increasing the content in the fluid fraction of linoleic acid, an essential fatty acid, while concentrating the tocopherols therein, which is a movement in the direction of maintaining the good initial equilibrium, which is not ensured by the prior art processes, for an equivalent linoleic acid content.

If the process according to the present invention has particular attraction in respect of its use for the treatment of palm oil from the present-day varieties the process is just as advantageously applied to the treatment of novel varieties and any other fat wherein the proportion of saturated fatty acids is too high to ensure that the oil is sufficiently fluid in temperate climates, for a salad oil.

Moreover, the methods of fractionation used in the process of the invention make it possible to produce a symmetrical oleodipalmitin, with industrially attractive yields, for producing a substitute for cocoa-butter, which has a good level of compatibility therewith.

Operation is in accordance with the following methods, for carrying out the process according to the present invention:

I. In accordance with FIG. 1*a* of the accompanying drawings:

(A) Palm oil which is preferably semi-refined is subjected to a fractionating process in a solvent phase, at a temperature of the order of 0° to +35° C., the oil/solvent proportion by weight being from 1/0.5 to 1/7 and preferably from 1/0.5 to 1/4, with the duration of the crystallisation operation being from 2 to 15 hours, preferably from 2 to 4 hours.

The solvent is advantageously trichlorotrifluoroethane, hexane, iso-propanol or acetone, and is preferably trichlorotrifluoroethane.

The temperature to which the mixture of palm oil and solvent is subjected is sufficiently low to cause cooling which will result in crystallisation of the saturated triglycerides with a very high melting point, essentially tripalmitin. The mixture is maintained at the above-indicated temperature, with slow agitation, for the period of time indicated hereinbefore, after which the proportion of saturated triglyceride crystals stabilises, the crystallised solid fraction ($C_1$) is separated from the fluid fraction ($F_1$) by a known solid-liquid separation process, for example by filtration under pressure on a filter cloth, for example of polyamide, with a porosity of 20μ: the fraction $C_1$ is washed on a filter with fresh solvent, and the miscella produced is introduced into the filtrate.

The solid fraction $C_1$ (SSS) which is obtained in a yield of about 5 to 15%, after removal of the solvent, has an iodine number of lower than 20, and may be used as it is.

(B) The intermediate fluid fraction $F_1$ which is produced in a yield of 85 to 95% is subjected to a fresh fractionating step in solvent phase at a lower temperature than that used in the first fractionating step, being from +15° to −20° C., with the $F_1$/solvent weight ratio preferably being from ½ to 1/7 and the time of the crystallisation operation being from 2 to 15 hours and preferably from 4 to 6 hours.

The same type of solvent as that used in the first fractionating step is preferably used in this step.

The temperature is sufficiently low to cause crystallisation of the triglycerides with a high melting point, essentially disaturated-monounsaturated triglycerides.

The fractionating operation is continued at the above-indicated temperatures and for the periods set out hereinbefore; the crystallised solid fraction ($C_2$) is then separated from the fluid fraction $F_2$ by filtration and washed on a filter as indicated hereinbefore.

The solid fraction $C_2$ which is produced after removal of the solvent is essentially formed by symmetrical monounsaturated-disaturated triglycerides and more particularly 2-oleo-1,3-dipalmitin (POP) which constitutes an excellent substitute base for cocoa-butter. The fraction $C_2$ whose iodine number is from 31 to 43 is produced in a yield of from 30 to 45% and can be used as it is.

(C) The intermediate fluid fraction $F_2$ is subjected to a free or directed interesterification treatment.

In the former case, after removal of the solvent, interesterification is effected in the presence of a catalyst which preferably comprises sodium methylate which is preferably present in a proportion of about 0.2% of the weight of $F_2$, for a period of about 30 to 60 minutes, at a temperature of the order of 60° to 80° C.

In the second case, directed interesterification may be effected with or without a solvent, in the presence of an interesterification catalyst which is preferably selected from the group of alkaline alcoholates, for example sodium methylate, in a proportion of 0.2 to 0.4% by weight of the $F_2$, for a period of from 1 to 3 hours and at a temperature of from 20° to 40° C., the solvent used preferably being hexane or trichlorotrifluoroethane, in oil/solvent proportions of from 1/0.05 to 1/0.4 by weight.

When the interesterification reaction is completed, the catalyst is destroyed by the addition of 3% of water or 1% of acetic acid for example.

The interesterified fluid fraction which is produced in this way is washed and dried by conventional means, after removal of the solvent, if appropriate.

(D) The interesterified fluid fraction which has been treated in this way is then subjected to a fresh fractionation step in solvent phase at a temperature of preferably −20° C., the fluid fraction/solvent weight ratio preferably being of the order of ⅓ to 1/7 and the duration of the crystallisation operation being of the order of 2 hours, the solvent used preferably being hexane or trichlorotrifluoroethane.

Once the crystallisation operation has been completed, a solid fraction $C_3$ is separated, for example by filtration, from a fluid fraction $F_3$.

The solid fraction $C_3$, from which the solvent has been removed, is produced in a yield of 10 to 30% and has an iodine number of from 33 to 43; it essentially comprises mixed triglycerides, which can be used in different sectors of the foodstuffs industry and in particular in the production of margarine, after conventional refining.

The fluid fraction $F_3$, from which the solvent has been removed, and which is produced in a yield of about 30 to 50%, has an iodine number of higher than 80; it essentially comprises unsaturated triglycerides and has a tri-unsaturated triglyceride content>20% and properties comparable to those of the usual edible oils such as peanut oil and olive oil, and in particular solidification and liquefaction characteristics similar to the latter, while also having an increased content of tocopherols (see Table I above).

II. In accordance with FIG. 1*b* of the accompanying drawings (A) Palm oil which is preferably semi-refined is subjected to a fractionating process in solvent phase, at a temperature of from +20° C. to −20° C., according to whether the oil/solvent weight ratio varies from 1/0.5 to 1/7. The duration of the crystallisation operation is preferably about 2 hours and the solvent is advantageously trichlorotrifluoroethane, hexane, isopropanol or acetone, and is preferably trichlorotrifluoroethane.

The mixture is kept under slow agitation for the above-indicated period, at the above-stated temperature, to cause cooling sufficient to result in crystallisation of trisaturated triglycerides and disaturated-monounsaturated triglycerides which are separated by filtration from a fluid fraction essentially comprising monosaturated-diunsaturated triglycerides.

The intermediate solid fraction which is produced in a yield of about 46% has an iodine number of the order of 31 and the intermediate fluid fraction which is obtained in a yield of about 54% has an iodine number of the order of 68.

(B) The intermediate solid fraction is subjected to a fresh fractionation step at a higher temperature than that of the first fractionating step, of the order of +10° C., in solvent phase, and the oil/solvent weight ratio can be up to 1/7.

The oil-solvent mixture is subjected to slow agitation for about 2 hours, after which two solid fractions $C_1$ and $C_2$ are collected. The fraction $C_1$ which is produced in a yield of the order of 10%, has an iodine number of lower than 20. It essentially comprises saturated triglycerides (SSS) which can be used as they are. The fraction $C_2$, which is produced in a yield of the order of 35% has an iodine number of the order of 40; it essentially comprises symmetrical monounsaturated-disaturated triglycerides and more particularly 2-oleo-1,3-dipalmitin which can be used as the substitute base for cocoa butter.

(C) The intermediate fluid fraction produced from the first fractionating operation is subjected to an interesterification process in the presence of a catalyst which preferably comprises for example sodium methylate, which is present for example in a proportion of from 0.2 to 0.3% by weight of the fraction to be interesterified, for a period of from 30 to 60 minutes at a temperature of the order of 80° C.; interesterification is preferably effected in oil phase but it may optionally also be carried out in solvent phase, under the conditions indicated in I.C) above.

When the reaction is completed, the catalyst is destroyed by any suitable means known per se and particularly by the addition of 3% of water or 1% of glacial acetic acid.

The interesterified fluid fraction is washed and dried with conventional means after removal of the solvent, if appropriate.

The interesterified fluid fraction which has been treated in this way is then subjected to a fresh fractionating step in solvent phase at a temperature which is preferably −20° C., the fluid fraction/solvent weight ratio preferably being of the order of ⅓ to 1/7 and the duration of the crystallisation operation being of the order of 2 hours, while the solvent used is preferably hexane or trichlorotrifluoroethane.

Once the crystallisation operation has been completed, filtration is then effected to separate a solid fraction $C_3$ with an iodine number of the order of 37, essentially comprising mixed triglycerides which can be used in different sectors of the foodstuffs industry and in particular in the production of margarine, and a fluid fraction $F_3$ with an iodine number of more than 80, essentially comprising unsaturated triglycerides and with a triunsaturated triglyceride content>20% and properties comparable to those of the usual edible oils, in particular with solidification and liquefaction properties similar to the latter. The fluid fraction $F_3$ also has an increased tocopherol content, as indicated above.

The yield in respect of the solid fraction $C_3$ is of the order of 18%, while the yield in respect of the fluid fraction $F_3$ is of the order of 36%.

Besides the foregoing measures and arrangements, the invention further comprises other arrangements and measures which will be apparent from the following description.

The present invention is concerned more particularly with a process for the production of a plurality of edible fractions from natural fatty substances, wherein the saturated/unsaturated ratio is from about 0.3 to about 1.2, and the fractions which are produced by carrying out the process of the invention, together with the means for carrying out the process and for producing said fractions, and the production trains in which said process may possibly be included.

The invention will be better appreciated by means of the further description set out below, which refers to Examples of the process according to the present invention. It will be appreciated however that these Examples are given solely by way of illustration of the invention, on which they do not in any way form a limitation.

EXAMPLES

EXAMPLE 1

Figure 1B:
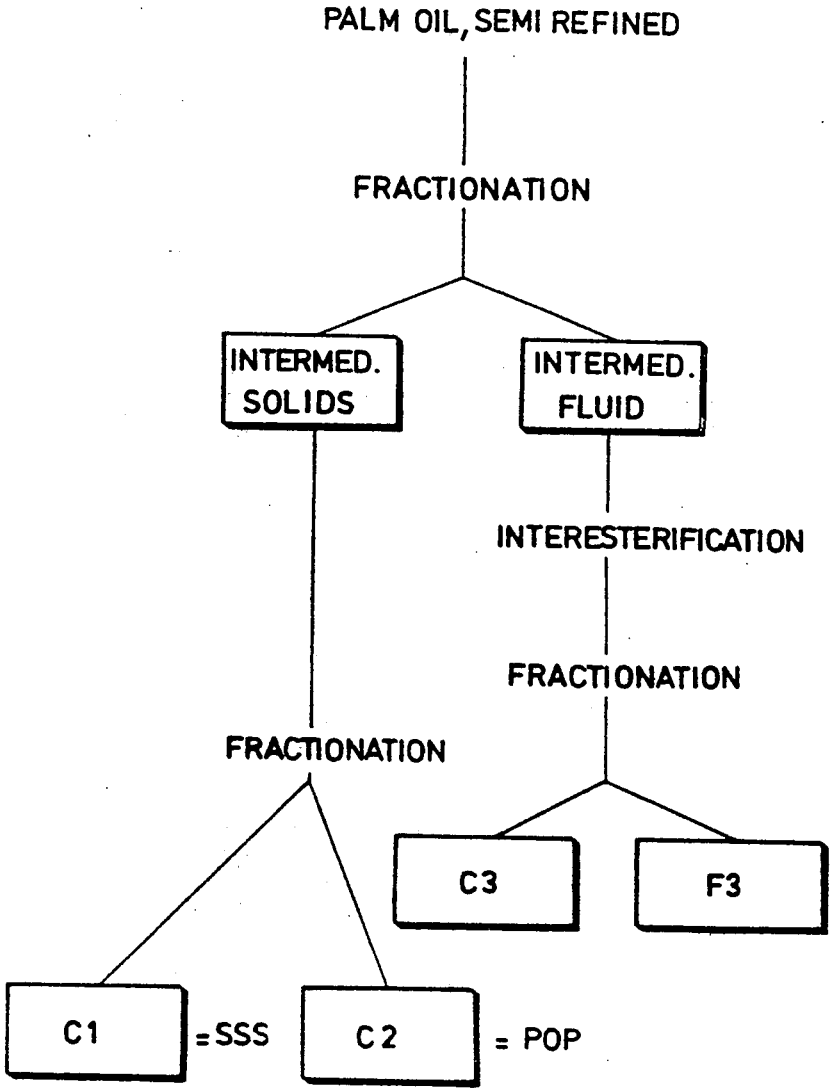

Operation is as shown in FIG. 1*b*.

100 kg of refined palm oil with an iodine number of 51, which is entirely molten at a temperature of 50° C., is mixed with 700 kg of trichlorotrifluoroethane.

The mixture which is cooled at a speed of 0.1° C./minute to a temperature of −10° C. is kept at this temperature for 2 hours, whereafter it is filtered under vacuum on polyamide cloth with a porosity of 20μ. The filtration cake is washed with twice 50 kg of fresh solvent.

The intermediate solid fraction (see FIG. 1*b*) is subjected to a fresh fractionating step after adjustment of the degree of dilution to one part of oil for 7 parts of solvent by weight, at a temperature of +10° C. After filtration, rinsing operations and removal of the solvent by distillation, the fatty material is recovered, which comprises two separate solid fractions, namely: a solid fraction $C_1$ which is produced in a yield of 11% and which essentially comprises saturated triglycerides (SSS) with an iodine number of 7, and a solid fraction $C_2$ which is produced in a yield of 35% and which essentially comprises symmetrical oleodipalmitin and whose iodine number is 39.

After removal of the solvent, the intermediate fluid fraction (see FIG. 1*b*) is subjected to random interesterification for a period of 1 hour at 80° C., using 0.2% of sodium methylate as the catalyst.

After destruction of the catalyst with 3% of water, centrifuging and washing of the oil, the oil is dried at a temperature of 90° C. under vacuum and is ready for a fractionating step.

The fractionating step is carried out under the same conditions as the first fractionating step, except for the fractionating temperature which is −20° C. After rinsing, the fluid fraction $F_3$ and the solid fraction $C_3$ which are produced have the solvent removed therefrom, and are then weighed and studied from the point of view of chemical composition and physical characteristics, jointly with the two other fractions which were previously produced.

TABLE II

| Fractions | Iodine number | Yield with respect to the whole palm oil |
|---|---|---|
| Intermediate fluid | 68 | 54% |
| Intermediate solid | 31 | 46% |
| Fluid $F_3$ | 83 | 36% |
| $C_3$ (SII/SSI) | 37 | 18% |
| $C_2$ (POP) | 39 | 35% |
| $C_1$ (SSS) | 7 | 11% |

EXAMPLE 2

Operation is as in FIG. 1*b*.

1 kg of refined palm oil with an iodine number of 51 at 50° C. is mixed with 7 kg of trichlorotrifluoroethane which is at a temperature of −20° C. The resulting mixture is at a temperature of about 0° C. This procedure makes it possible substantially to reduce the cooling time. The remainder of the operations is identical to those set out in Example 1, except for the temperature in the first fractionating step which is minus 5° C.

The following fractions are produced:

TABLE III

| Fractions | Iodine number | Yield with respect to the whole palm oil |
|---|---|---|
| Intermediate fluid | 65 | 60% |
| Intermediate solid | 31 | 40% |
| Fluid $F_3$ | 84 | 23% |
| $C_3$ (SII/SSI) | 36 | 37% |
| $C_2$ (POP) | 40 | 28% |
| $C_1$ (SSS) | 9 | 12% |

EXAMPLE 3

Operation is as shown in FIG. 1*b*.

Hexane is used instead of trichlorotrifluoroethane. The ratios in respect of dilution of the oil and the temperatures are, for the first fractionating step: $\frac{1}{4}$ (volume oil per volume of hexane) and −15° C.; for the second fractionating step: $\frac{1}{4}$ and −20° C.; and for the third fractionating step: $\frac{1}{4}$ and +10° C. The palm oil fractions produced have the characteristics set out in Table IV below. The other operations remain identical to those set out in Example 1.

TABLE IV

| Fractions | Iodine number | Yield with respect to the whole palm oil |
|---|---|---|
| Intermediate fluid | 68 | 56% |
| Intermediate solid | 30 | 44% |
| Fluid $F_3$ | 84 | 38% |
| $C_3$ (SSI/SII) | 36 | 18% |
| $C_2$ (POP) | 38 | 34% |
| $C_1$ (SSS) | not measured | 10% |

EXAMPLE 4

95% isopropanol is used for the first fractionating step, in a dilution ratio of $\frac{1}{3}$ (volume/volume). The intermediate solid fraction produced has a glyceridic composition which is different from the solids produced when using the above-indicated apolar solvents. The proportion of partial glycerides (diglycerides in particular) is lower (see Table V below).

TABLE V

| FIG. 1b | 1-2 Diglycerides % | 1-3 Diglycerides % |
|---|---|---|
| Intermediate solid produced with apolar solvent (hexane) | 1.7 | 4.4 |
| Intermediate solid produced with polar solvent | | |

TABLE V-continued

| FIG. 1b | 1-2 Diglycerides % | 1-3 Diglycerides % |
|---|---|---|
| (isopropanol) | <1.0 | <3.0 |

The fluid fraction $F_1$ is interesterified after complete removal of the alcohol and is subjected to interesterification and second fractionating operations which are identical to those set out in Examples 1 and 3.

Table VI below shows the composition in respect of stearic, palmitic, oleic and linoleic acids, in the fluid fraction $F_3$ produced in accordance with Examples 1 and 3.

TABLE VI

| | $F_3$ Example 1 | $F_3$ Example 3 |
|---|---|---|
| $C_{16}$ | 19.6 | 19.7 |
| $C_{18}$ | 2.3 | 2.4 |
| $C_{18=}$ | 51.8 | 51.5 |
| $C_{18==}$ | 21.5 | 22.5 |
| Iodine number | 83 | 84 |
| Yield with respect to the basic palm oil | 36% | 38% |

The proportion of reducing tocopherols (active antioxygens) in the fluid fraction $F_3$ which is produced in accordance with Example 3 was determined by colorimetry by the bathophenanthroline method which is based on the oxidation of the tocopherols by ferric chloride in alcoholic solution, the subsequent formation of the complex $Fe^{++}$/bathophenanthroline, and measurement at 532 mμ of the specific extinction of the coloured complex formed.

This operation gave the following results:

Fraction $F_3$:

before deodorisation: 75 mg*/100 g of oil after deodorisation: 40 mg*/100 g of oil

*unit: tocopherols expressed at mg of α-tocopherol for 100 g of oil.

EXAMPLE 5

Operation is as shown in FIG. 1*a*.

1 kg of palm oil is crystallised at 0° C. in solvent phase, comprising 7 kg of trichlorotrifluoroethane (ratio 1/7), for a period of 2 hours.

A solid fraction $C_1$ SSS with an iodine number of 7 which can be used for lipochemical uses and a fluid fraction $F_1$ with an iodine number of 54 are separated by filtration on a polyamide cloth with a porosity of 20μ.

The fluid fraction $F_1$ is fractionated with 7 times its weight of trichlorotrifluoroethane at a temperature of −15° C. for a period of 4 hours, whereafter filtration on a polyamide cloth with a porosity of 20μ is carried out to separate a solid fraction $C_2$ POP with an iodine number of 43 and which can be used as a substitute base for cocoa-butter, and a fluid fraction $F_2$ with an iodine number of 73, which is subjected to random interesterification for 1 hour at 80° C. in the presence of 0.3% of sodium methylate.

After this period of time, the interesterification operation is stopped by destroying the catalyst by introducing 3% of glacial acetic acid, and the interesterifieid fluid fraction is fractionated in solvent phase in 7 times its weight of trichlorotrifluoroethane, for a period of 2 hours at −20° C.

Filtration is effected to separate a solid fraction $C_3$ which comprises mixed triglycerides with an iodine number of 33 and which can be used in particular in the production of margarine, and a fluid fraction $F_3$ with an iodine number of 85, wherein the tocopherol content is 79 mg/100 g before deodorisation and 64 mg/100 g after deodorisation.

The yields obtained in this Example are as follows:

TABLE VII

| Fraction | Yield with respect to the basic palm oil |
|---|---|
| $C_1$ | 10% |
| $C_2$ | 42% |
| $C_3$ | 12% |
| $F_3$ | 36% |

The solidification and liquefaction characteristics of the fluid fraction $F_3$ which is produced in accordance with Example 5 and the fluid fraction $F_3$ which is obtained in accordance with Example 1 were determined by measuring the end-of-clouding point and stability at +15° C. The end-of-clouding point (E.C.P.) is measured as follows: a sample of fatty material (about 50 ml) is placed in a test tube in which a precision thermometer is immersed, surrounded by a jacket; the sample is cooled overnight at −20° C.; it is then placed in a tank containing a bath of water which is thermostatically controlled to a temperature selected in a range of from +25° to +40° C.; as soon as the oil has become clear, the temperature at which the oil has become clear is read on the thermometer, this temperature being called the 'end-of-clouding point'.

The solidification/liquefaction test comprises cooling the oil overnight at 0° C. and observing the time for liquefaction of the oil when returned to an ambient temperature of +15° C. The liquefaction time is taken when the oil is perfectly clear and is compared to the liquefaction time of peanut oil which has been cooled under the same conditions as the fluid according to the invention.

The results obtained are set out in Table VIII below, in comparison with the results obtained with peanut oil:

TABLE VIII

| | Peanut | Fluid $F_3$ Example 1 | Fluid $F_3$ Example 5 |
|---|---|---|---|
| E.C.P. | — | 8° C. | 9° C. |
| Stability at +15° C. | Complete liquefaction - remains clear at this temperature | Complete liquefaction at +15° C. - remains clear at this temperature | Complete liquefaction at +15° C. - remains clear at this temperature |
| I.N. | 93.3 | 83 | 85 |

It will be seen from the foregoing description that, irrespective of the modes of performance and use adopted, the invention provides a process for the production of a plurality of edible fractions from natural fatty substances, which has substantial advantages over the previously known processes seeking to achieve the same aim, some of which advantages have been set out hereinbefore and others of which will be apparent from use of the process.

As will be seen from the foregoing, the invention is in no way limited to those of its modes of performance and use which have been described in greater detail hereinbefore; on the contrary, it covers all alternative forms which may be envisaged by the man skilled in the art, without departing from the limits or the scope of the present invention.

We claim:

1. A process for the treatment of natural fatty substances for the production of edible fractions, comprising primary stages of fractionation of the oil to be treated by means of suitable fat-fractionating solvents, which are present in an amount from 0.5 to 7 times the weight of the oil, at temperatures of from +35° C. to −20° C., to produce one or two solid fractions, which are washed with fresh solvent, and an intermediate fluid fraction, and a stage of interesterification of the intermediate fluid fraction, which is carried out in the presence of a suitable interesterification catalyst at a temperature of from 20° to 80° C., said primary fractionation stages being associated with a complementary stage of fractionation of the intermediate interesterified fluid fraction and optionally being associated with complementary stages of fractionation of the solid fraction or fractions, the complementary fractionating stages using a suitable fat-fractionating solvent in order to produce four fractions that have properties of edible fats, namely: a fluid fraction with an iodine number of higher than 80, containing more than 20% of unsaturated triglycerides, and free of trans isomers; a solid fraction having an iodine number of from 31 to 43, that essentially contains 2-oleo-1,3-dipalmitin (POP); a solid fraction (SSI/SII) with an iodine number of from 33 to 43, that contains mixed triglycerides; and a solid fraction (SSS) with an iodine number of lower than 20 and essentially containing saturated triglycerides, whereby all fractions retain their properties as edible oils and solids.

2. A process according to claim 1 in which the fatty substance is a palm oil or a palm oil fraction having a ratio of saturated to unsaturated substances of from 0.3:1 to 1.2:1.

3. A process according to claim 1 or 2 in which a first fractionating stage is carried out at a temperature of from 0° to +35° C. with oil:solvent ratios of from 1:0.5 to 1:7, to give a solid fraction that essentially comprises saturated triglycerides and has an iodine number of less than 20, and an intermediate fluid fraction, which is subjected to a fresh fractionating treatment at a temperature of from +15° to −20° C. in from 2 to 7 times its weight of fractionating solvent to produce a solid fraction that essentially comprises 2-oleo-1,3-dipalmitin and an intermediate fluid fraction, which is subjected to interesterification in the presence of a suitable catalyst at a temperature of the order of from 20° to 80° C. for a period of from 30 minutes to 6 hours, followed by a fresh fractionating step in a fractionating solvent present in a proportion of up to 7 times the weight of the interesterified fluid fraction to be treated, at a temperature ranging up to −20° C., to produce a solid fraction that essentially comprises mixed triglycerides and has an iodine number of from 33 to 43, and a fluid fraction that essentially comprises unsaturated triglycerides and has an iodine number of higher than 80.

4. A process according to claim 1 or 2 in which the first fractionating stage is carried out at a temperature of from +20° C. to −20° C., according to the variation of the weight of the fractionating solvent between 1 and 7 times the weight of the oil to be treated, to produce a solid fraction, which is subjected to a fresh fractionating step in a solvent medium, which makes it possible to recover a solid fraction essentially comprising saturated triglycerides with an iodine number of less than 20, a second solid fraction essentially comprising 2-oleo-1,3-dipalmitin, and an intermediate fluid fraction which is subjected to an interesterification treatment at a temperature of 20° to 80° C. in the presence of a suitable interesterification catalyst, whereafter there is produced a solid fraction which essentially comprises mixed triglycerides with an iodine number which can attain 43, and a fluid fraction with an iodine number of more than 80.

5. A process according to claim 1 in which the fractionating solvent used is selected from the group consisting of trichlorotrifluoroethane, hexane, isopropanol and acetone.

6. A process according to claim 5 in which, for the steps for producing the fluid fraction with an iodine number of more than 80, the fractionating solvent used is selected from the group consisting of trichlorotrifluoroethane and hexane.

7. A process according to claim 1 in which the different fractionating stages of the process are performed by using one or more fractionating solvents, separately or in mixtures.

8. A process according to claim 1 in which the fractionating operations are carried out using amounts of solvent representing from 0.5 to 7 times the weight of the oil or the fraction treated, the fractionating temperature being from +35° C. to −20° C., depending on the proportion and type of fractionating solvent relative to the oil or the fraction treated.

9. A process according to claim 1 in which the interesterification step is a free interesterification operation carried out in oil phase at a temperature of from 60° to 80° C. in the presence of a suitable interesterification catalyst for a period of from 30 to 60 minutes.

10. A process according to claim 1 in which the interesterification step is a directed interesterification operation which is carried out in oil phase at a temperature of 20° C. to 40° C. in the presence of a suitable interesterification catalyst for a period of from 1 to 6 hours.

11. A process according to claim 1 in which the interesterification step is a directed interesterification operation carried out in solvent phase, the oil:solvent proportion being 1:0.05 to 1:0.4 by weight, at a temperature of 20° to 40° C. in the presence of a suitable interesterification catalyst for a period of from 1 to 6 hours.

12. A process according to claim 10 or 11 in which the said period is from 1 to 3 hours.

13. A process as claimed in any one of claims 9 to 11 in which the interesterification catalyst is an alkali metal alcoholate.

14. A process according to any one of claims 9 to 13 in which the amount of catalyst used is from 0.2 to 0.4% by weight of the weight of the fraction subjected to interesterification, the catalyst being destroyed once the interesterification reaction is completed.

15. Fractions of fatty substances produced by carrying out a process according to claim 1, 2 or any of 5 to 11.

16. Fractions according to claim 15 produced in yields of from 30 to 70% approximately for the fluid fraction, from 10 to 45% approximately for the solid fraction POP, from 10 to 30% approximately for the solid fraction SSI/SII, and from 1 to 15% approximately for the solid fraction SSS.

17. A fluid fraction according to claim 16 having no trans isomers, an iodine number higher than 80, a proportion of tri-unsaturated triglycerides greater than 20%, a proportion of tocopherols higher than 30 mg/100 g of the fluid fraction, an end-of-clouding point of less than 12° C., a proportion of SSS less than 0.6%, a proportion of SSI less than 10%, and a solidification/-liquefaction time at +15° C. comparable to that of peanut oil.

18. A solid fraction suitable as a substitute for cocoa butter according to claim 16 preponderantly containing symmetrical oleodipalmitin (POP), having an iodine number of from 31 to 43.

19. A solid fraction according to claim 16 essentially comprising mixed triglycerides SSI/SII with an iodine number of from 33 to 43.

20. A solid fraction according to claim 16 essentially comprising saturated triglycerides SSS with an iodine number of less than 20.

* * * * *